US005971226A

United States Patent [19]

Goncalves

[11] Patent Number: 5,971,226

[45] Date of Patent: Oct. 26, 1999

[54] CONTROL MECHANISM WITH SIDE PUSH BUTTONS FOR THE DISTRIBUTION OF A PRODUCT CONTAINED IN A RECEPTACLE

[75] Inventor: Agnès Goncalves, Soisy-sous-Montmorency, France

[73] Assignee: DEFI International, Sous Montmorency, France

[21] Appl. No.: 08/716,310

[22] PCT Filed: Jan. 26, 1996

[86] PCT No.: PCT/FR96/00135

§ 371 Date: Sep. 27, 1996

§ 102(e) Date: Sep. 27, 1996

[87] PCT Pub. No.: WO96/22928

PCT Pub. Date: Aug. 1, 1996

[30] Foreign Application Priority Data

Jan. 27, 1995 [FR] France ..... 95 00956

[51] Int. Cl.[6] ..... B67D 5/42

[52] U.S. Cl. ..... 222/321.6; 222/321.8; 222/402.13; 222/402.15; 222/507; 222/509

[58] Field of Search ..... 222/402.13, 402.15, 222/505, 507, 321.8, 509, 383.7, 385, 378, 380, 321.6

[56] References Cited

U.S. PATENT DOCUMENTS

| | | | |
|---|---|---|---|
| 3,272,392 | 9/1966 | Meshberg | 222/162 |
| 3,323,690 | 6/1967 | Monahon | 222/402.13 |
| 3,361,301 | 1/1968 | Meshberg | 222/402.13 X |
| 3,404,814 | 10/1968 | Wakeman | 222/402.13 |
| 3,409,186 | 11/1968 | Melocchi | 222/402.13 |
| 3,888,392 | 6/1975 | Van Coney | 222/402.13 X |
| 3,946,911 | 3/1976 | Morane et al. | 222/402.11 |
| 4,640,493 | 2/1987 | Dudzik | 222/509 X |
| 4,860,933 | 8/1989 | Morane et al. | 222/402.13 |
| 5,139,180 | 8/1992 | Lucas | 222/402.13 |
| 5,230,447 | 7/1993 | Kirk | 222/505 |
| 5,271,542 | 12/1993 | Marston | 222/507 X |

FOREIGN PATENT DOCUMENTS

| | | | |
|---|---|---|---|
| 0098476 | 1/1984 | European Pat. Off. | B65D 83/14 |
| 0298847 | 1/1989 | European Pat. Off. | B65D 83/14 |
| 2600976 | 1/1988 | France | B65D 41/16 |
| 2194223 | 3/1988 | United Kingdom | B65D 41/16 |
| 2219352 | 12/1989 | United Kingdom | 222/402.13 |

*Primary Examiner*—Kenneth Bomberg
*Attorney, Agent, or Firm*—Greenblum & Bernstein, P.L.C.

[57] ABSTRACT

Control mechanism with at least two side push buttons for the distribution of a product contained in a receptacle. The control mechanism includes an end piece capable of being mounted on an opening of a receptacle and a cap capable of being arranged on the receptacle so as to cover the end piece. The cap is provided with at least one outlet hole for the product. At least two side push buttons, which are also provided on the cap, are diametrically opposed lever action push buttons which are hinged to swing inward and are secured to stops. The cap further includes a mechanism capable of fixing the cap on the receptacle. The end piece is capable of being movably mounted on the opening of the receptacle. The end piece includes at least two diametrically opposed radial support surfaces, on which the stops of the at least two side push buttons are pressed such that a lateral pressure applied on the at least two push buttons causes an axial displacement of the end piece from a closed position to an open position. An elastic mechanism is provided to bias the end piece against action of the push buttons in order to enable the end piece to resume its closed position.

20 Claims, 2 Drawing Sheets

CONTROL MECHANISM WITH SIDE PUSH BUTTONS FOR THE DISTRIBUTION OF A PRODUCT CONTAINED IN A RECEPTACLE

BACKGROUND OF THE INVENTION

1. Field of the Invention

The invention relates to a control mechanism with side push buttons for the distribution of a product contained in a receptacle.

2. Discussion of Background

There are numerous systems to ensure the distribution of a product contained in a receptacle.

Whether it is a distributing capsule for a pasty or liquid product contained in a receptacle with a vaporizing pump, or of the aerosol-type, it is always necessary to open the capsule and/or to control the pump or valve of the aerosol receptacle.

To this end, it is necessary to provide an opening and/or actuating mechanism.

The known systems generally comprise translative slides and/or rotating capsules.

To particularly facilitate the handling, one has imagined a mechanism with side push buttons, for example, such as that described especially in the patent FR-2 600 976, and which comprises an end piece mounted on an opening of the receptacle and a cap that is arranged on the receptacle so as to cover said end piece and is provided with at least one outlet opening for the product and at least two diametrically opposed lever-action side push buttons which are hinged to swing inward and are secured to stops.

However, in this device, the end piece serving as a shutter is fixedly mounted on the neck of the receptacle while the cap is movable, whereas a means for returning to the closing position is not provided.

SUMMARY OF THE INVENTION

The inventor proposes a control mechanism with side push buttons for the distribution of a product contained in a receptacle of the aforementioned general type, but which is advantageously different therefrom in that the cap is fixed on the receptacle whereas the end piece is movably mounted on the opening of the receptacle and comprises at least two diametrically opposed radial support surfaces, on which said stops of the side push buttons are pressed, such that a lateral pressure applied on said push buttons causes an axial displacement of the end piece from a closing position toward an opening position, whereas an elastic means is provided to bias the end piece against the action of the push buttons in order to enable it to resume its initial closing position.

Preferably, the push buttons are in one piece with the cap and are hinged by means of hinges with weakening grooving or tapering.

For example, the elastic means for returning to the initial position of the end piece is constituted by at least two elastic lugs arranged at the base of the end piece, and which take support through their free ends on the fixed portion of the receptacle. According to a particular embodiment, the elastic lugs are a part of an elastic crown that has a generally truncated shape and which is constituted by a plurality of such elastic lugs.

According to an embodiment, the end piece comprises a central chimney whose end is provided with at least one opening for passage of the product, and which is slidably imperviously mounted in a skirt of the cap arranged around the hole thereof.

In this case, for example, the hole of the cap is provided at the end of a protuberance in which the end of the chimney of the end piece is introduced.

More particularly, but not exclusively, for a serving capsule, the end piece comprises an end provided to close the hole of the cap while the opening for passage of the end piece is closed by a portion of the cap in the closing position and, on the contrary, communicates with the hole of said cap in the opening position.

For a receptacle provided with an aperture neck, the end piece is slidably mounted in and/or on said receptacle neck, for example, and can have, to this end, an inner skirt that slides on the inner wall of the receptacle neck.

In its application for an aerosol receptacle, an appropriate portion of the end piece is provided to rest on the receptacle valve rod such that the actuation of the push buttons acts on said valve.

Similarly, for a receptacle provided with a vaporizing pump, an appropriate portion of the end piece is provided to rest on said vaporizing pump arranged on the receptacle such that the actuation of the push buttons acts on said pump.

According to a very interesting embodiment, the hole of the cap communicates with a product applicator.

For example, the applicator has the shape of a porous element capable of becoming saturated with the product.

BRIEF DESCRIPTION OF THE DRAWINGS

The invention will be better understood and other characteristics will become apparent upon reading the description that follows, with reference to the annexed drawings, in which.

Since the two embodiments shown are based on the same invention, similar or comparable means have the same reference numerals.

DETAILED DESCRIPTION

Figure 1:
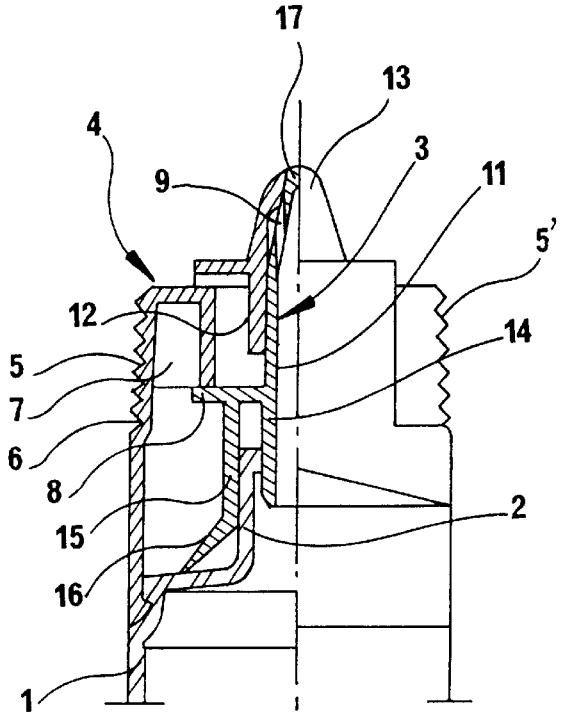
FIG. 1 is an elevational and half-sectional view of a capsule according to the invention in the closing position.

In the drawings, a receptacle is schematically designated by reference numeral 1, which contains the product to be distributed.

Figure 2:
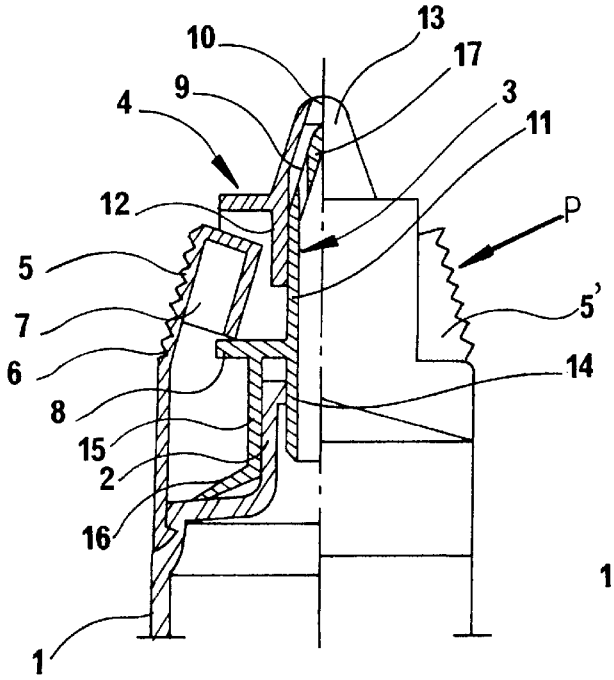
FIG. 2 corresponds to FIG. 1, but in the opening position.

In FIGS. 1 and 2, the receptacle 1 further comprises a neck 2.

In these embodiments, the invention provides an end piece 3 movably mounted on an opening of the receptacle and, for FIGS. 1 and 2 in this case, on the neck 2 of said receptacle.

A cap 4 is also provided which is fixed on the receptacle by clipping, for example, such that said cap 4 is totally immovable with respect to said receptacle 1.

The cap 4 is provided with two diametrically opposed side push buttons 5, 5' having a lever (which is integral here with the remainder of the cap), and hinged as shown in the drawings, so as to be capable of swinging inward by means, as is the case here for example, of hinges with weakening grooving or tapering such as designated by reference numeral 6.

The push buttons 5 and 5' are each equipped with stops 7 provided to take support on at least two radial and diametrically opposed support surfaces 8, 8' provided on the end piece 3.

The end piece 3 is provided with at least one opening 9 for passage, and the cap 4 with at least one hole 10.

The end piece 3 further comprises a central chimney 11 provided with the opening 9 and which is slidably imperviously mounted in a conjugated skirt 12 of the cap provided around the holes(s) 10 thereof.

In the embodiment of FIGS. 1–4, the hole 10 of the cap 4 is provided at the end of a protuberance 13 in which the tip of the chimney 11 of the end piece 3 is introduced, said protuberance serving a means for pouring or applying the product et even being capable of constituting an actual nozzle.

Still in the embodiments of FIGS. 1–4, the end piece 3 is provided with an inner skirt 14 that slides in the neck 2 of the receptacle 1, the end piece 3 being additionally provided with a skirt 15 that slides on said neck 2.

In FIGS. 1, 2, 4, and 5, it can be further noted that the end piece 3 is provided with elastic lugs 16 adapted to take support on a fixed portion of the receptacle 1 (for example, around the neck 2).

Figure 4:
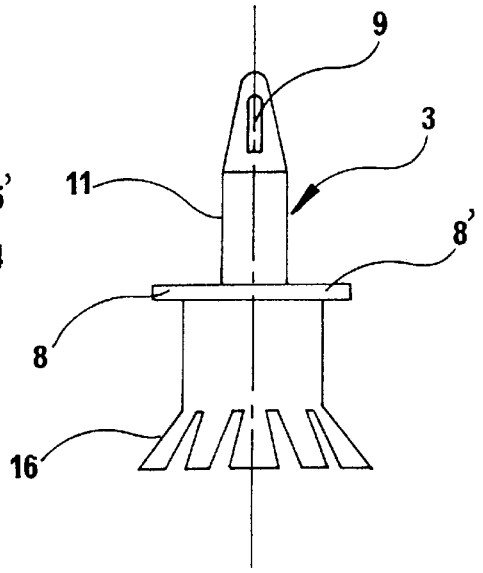
FIG. 4. shows the movable end piece of the device of FIGS. 1–3.
Figure 5:
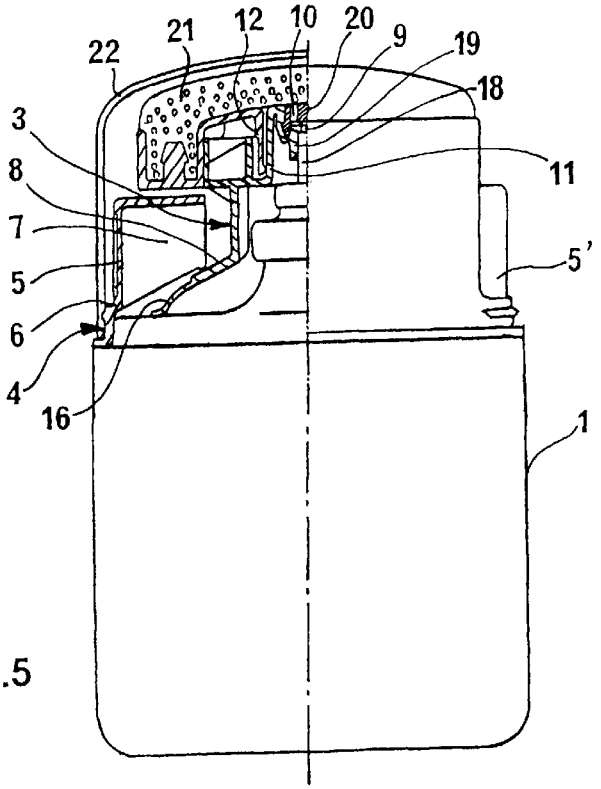
FIG. 5 is an elevational and half-sectional view of an embodiment for an aerosol receptacle provided with a porous element-type applicator.
Figure 6:
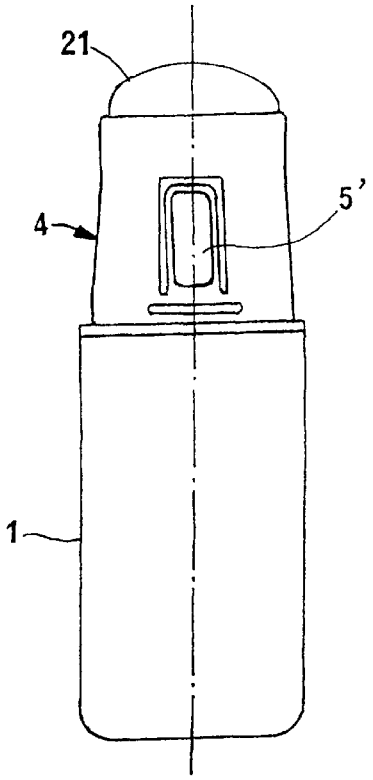
FIG. 6 is a side view of the device of FIG. 5.

In the embodiment of FIGS. 1, 2 and 4, the lugs 16 are a part of a ring having a generally truncated shape, as shown particularly in FIG. 4, whereas in the embodiment of FIGS. 5 and 6, particularly in view of the non-cylindrical shape, the lugs are, for example, two in number and diametrically opposed. In FIGS. 1, 2, and 4, the lugs 16 extend the skirt 15 of the end piece 3, whereas in FIG. 5, each lug 16 extends the corresponding support surface 8 of said end piece 3.

In the embodiment of FIGS. 1–4, it is noted that in the closing position (FIG. 1), the end piece 3 comprises an end 17 that closes the hole 10 of the cap 4, whereas, on the contrary, it clears said hole in the opening position (FIG. 2), thus causing the opening 9 and the hole 10, of the end piece and of the cap, respectively, to communicate, the opening 9 remaining imperviously isolated from the remainder of the cap due to the skirt 12 of the latter.

In the embodiment of FIGS. 5 and 6, the opening 9 and the hole(s) 10 are always in communication for the reasons stated hereinafter.

In the embodiment of FIGS. 5 and 6, the receptacle 1 is of the aerosol type, one portion 19 of the end piece 3 coming to be supported on the control rod 18 of the valve of the receptacle. It is this portion 19 of the end piece 3 of FIG. 5 that is provided with the opening 9 whereas the hole(s) 10 of the cap are, for example, provided in a small attached element 20.

However, the receptacle 1 could of course comprise a pulverizing pump, the reference numeral 18 being capable of representing the portion of this pump on which the portion 19 of the end piece 3 rests.

In addition, the embodiment of FIGS. 5 and 6 is provided with a product applicator, which here is a dome-shaped porous element 21 fixed in the cap 4.

To protect the applicator 21, a cap 22 is additionally provided here which covers the assembly.

It is understood that FIGS. 1–4 relate more particularly to a receptacle provided with a single flow distributing capsule, and that FIGS. 5 and 6 are related to a receptacle of the aerosol-type or having a pump with, in addition, a porous element applicator.

However, it is clear that these devices are equipped with the same mechanism and function in the same manner by acting on the side push buttons 5, 5'.

Figure 3:
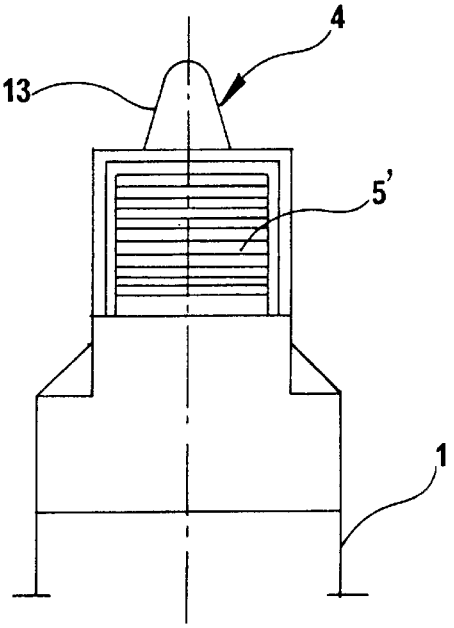
FIG. 3 is an elevational view of the device of FIGS. 1 and 2 on the side of a push button.

Initially, for the receptacle of FIGS. 1–3, the end 17 of the end piece 3 closes the hole 10 of the cap (FIG. 1), whereas the receptacle of FIGS. 5 and 6 is closed by the absence of pressure on the control rod 18 (or on the pump, respectively).

By applying a pressure on the side push buttons 5, 5' in the direction of the arrow P of FIG. 2 (which of course also applies to FIG. 5), the stops 7 of said push buttons, in the form of small plates or stirrups, for example, and which rest on the surfaces 8, 8' of the end piece 3, force the latter to penetrate into the receptacle (one thus moves from FIG. 1 to FIG. 2).

The translative pressure of the end piece 3 therefore makes it possible to clear the hole 10 of the cap 4 (FIG. 2), or else to open the valve of the aerosol of FIGS. 5 and 6.

In this way, the product contained in the receptacle 1 can flow through the openings 9 and the holes 10, either directly (FIGS. 1–4), or by soaking the porous element applicator 21 (FIGS. 5 and 6).

It is understood that the angle of movement for the push buttons is calculated to allow for a sufficient translation of the end piece 3.

Furthermore, it is also understood that a more or less substantial pressure on the push buttons enables a control of the flow rate.

When the pressure on the push buttons ceases, the elastic lugs 16 bring the end piece back towards its initial position.

In the case of FIGS. 5 and 6, the spring with which the valve of the aerosol (or the pump) is equipped and/or the internal pressure applied on the latter, contribute to this return to the initial position (possibly, the lugs 16, in certain cases, may not prove indispensable).

Finally, it is obvious that the porous element applicator 21 of FIGS. 5 and 6 can equip a receptacle of the type of those of FIGS. 1–3, i.e., without pump or aerosol (usage by turning upside down and/or by pressure applied on the sides of the receptacle which, to this end, would be flexible).

What is claimed is:

1. A control mechanism for distribution of a product contained within a receptacle, comprising:

an end piece capable of being movably mounted on an opening of a receptacle, the end piece having an elastic base portion formed of one piece with the end piece; and a cap capable of being fixedly arranged on the receptacle and covering the end piece, the cap being provided with at least one outlet hole for a product contained within the receptacle, the cap having at least two push buttons arranged such that a lateral pressure applied on the at least two push buttons causes an axial displacement of the end piece from a closed position to an open position, wherein the elastic base portion of the end piece is capable of being supported on a fixed exterior portion of the receptacle to bias the end piece against action of the at least two push buttons to enable the end piece to resume the closed position.

2. The control mechanism of claim 1, wherein the elastic base portion of the end piece comprises at least two elastic lugs, the elastic lugs having free ends capable of being supported on the fixed portion of the receptacle.

3. The control mechanism of claim 2, wherein the elastic lugs comprise an elastic crown that has a generally truncated shape.

4. The control mechanism of claim 3, wherein the elastic crown is comprised of a plurality of elastic lugs.

5. The control mechanism of claim 1, wherein the at least two push buttons comprise lever-action push buttons which are hinged to swing inward and are affixed to stops, and wherein the end piece comprises at least two radial support surfaces on which the stops of the at least two push buttons are pressed.

6. The control mechanism of claim 1, wherein the at least two push buttons are in one piece with the cap and are hinged by hinges.

7. The control mechanism of claim 6, wherein the hinges comprise at least one of weakening, tapering, and grooves.

8. The control mechanism of claim 1, wherein the end piece comprises a central chimney having an end which is provided with at least one opening for passage of the product of the receptacle, the chimney being slidably imperviously mounted in a skirt of the cap arranged around the at least one outlet hole of the cap.

9. The control mechanism of claim 8, wherein the cap comprises a protuberance in which the at least one outlet hole of the cap is provided, the end of the chimney which is provided with at least one opening being disposed in the protuberance of the cap.

10. The control mechanism of claim 8, wherein the end of the chimney having at least one opening is capable of closing the at least one outlet hole of the cap when the opening of the chimney is closed by a portion of the cap in the closed position, the at least one opening of the chimney conmmunicating with the at least one outlet hole of the cap in the open position.

11. The control mechanism of claim 1, wherein the end piece is capable of being slidably mounted such that the end piece is at least one of in and on a neck of the receptacle which neck is adjacent to the opening of the receptacle.

12. The control mechanism of claim 11, wherein the end piece has an inner skirt capable of sliding on an inner wall of the neck of the receptacle.

13. The control mechanism of claim 1, wherein a portion of the end piece is capable of resting on an aerosol valve rod of the receptacle such that actuation of the at least two push buttons acts on the aerosol valve rod.

14. The control mechanism of claim 1, wherein a portion of the end piece is capable of resting on a vaporizing pump of the receptacle such that actuation of the at least two push buttons acts on the vaporizing pump.

15. The control mechanism of claim 1, wherein the at least one outlet hole of the cap communicates with a product applicator.

16. The control mechanism of claim 15, wherein the applicator comprises a porous element capable of being saturated with product.

17. The control mechanism of claim 1, wherein the end piece is capable of being slidably mounted such that the end piece is at least one of in and on a neck of the receptacle which neck is adjacent to the opening of the receptacle, and wherein a portion of the end piece is capable of resting on an aerosol valve rod of the receptacle such that actuation of the at least two push buttons acts on the aerosol valve rod.

18. A control mechanism for distribution of a product contained within a receptacle, comprising:

an end piece capable of being movably mounted on an opening of a receptacle, the end piece having an elastic base portion formed of one piece with the end piece; and a cap capable of being fixedly arranged on the receptacle and covering the end piece, the cap being provided with at least one outlet hole for a product contained within the receptacle, the cap having a pressure conversion means for converting a lateral pressure to an axial displacement of the end piece from a closed position to an open position, wherein the elastic base portion of the end piece is capable of being supported on a fixed exterior portion of the receptacle to bias the end piece against action of the pressure conversion means to bias the end piece toward the closed position.

19. The control mechanism of claim 18, wherein the pressure conversion means comprises at least two push buttons.

20. The control mechanism of claim 18, wherein the elastic base portion of the end piece comprises at least two elastic lugs, the elastic lugs having free ends capable of being supported on the fixed portion of the receptacle.

* * * * *

UNITED STATES PATENT AND TRADEMARK OFFICE

CERTIFICATE OF CORRECTION

PATENT NO. : 5,971,226

DATED : October 26, 1999

INVENTOR(S) : A. GONCALVES

It is certified that error appears in the above-identified patent and that said Letters Patent is hereby corrected as shown below:

On the title page, item: [73], Assignee, change the address of the assignee, DEFI International, from "Montmorency, France" to ---Soisy-Sous-Montmorency, France---.

Signed and Sealed this

Thirty-first Day of October, 2000

*Attest:*

*Attesting Officer*

Q. TODD DICKINSON

*Director of Patents and Trademarks*